US005280218A

United States Patent [19]

Smith

[11] Patent Number: 5,280,218

[45] Date of Patent: Jan. 18, 1994

[54] ELECTRODES WITH PRIMARY AND SECONDARY EMITTERS FOR USE IN CROSS-FIELD TUBES

[75] Inventor: Burton H. Smith, Lexington, Mass.

[73] Assignee: Raytheon Company, Lexington, Mass.

[21] Appl. No.: 764,604

[22] Filed: Sep. 24, 1991

[51] Int. Cl.[5] ..... H01J 23/04; H01J 25/50; H01J 25/42

[52] U.S. Cl. ..... 315/39.3; 315/39.51; 315/39.63; 315/39.67; 330/47; 331/89; 313/304; 313/338

[58] Field of Search ..... 315/5.11, 5.12, 5.33, 315/39.3, 39.51, 39.63, 39.67, 39.75; 313/304, 338; 330/42, 47; 331/89

[56] References Cited

U.S. PATENT DOCUMENTS 2,409,038 10/1946 Hansell ..... 331/89 X
2,475,526 7/1949 Spencer ..... 315/39.63 X
2,808,568 10/1957 Cuccia ..... 315/39.63 X
2,818,528 12/1957 Feinstein ..... 315/39.63 X
2,832,005 4/1958 Brown ..... 315/39.75 X
2,869,031 1/1959 Brett ..... 313/346 R X
3,278,791 10/1966 Foure ..... 315/39.3 X
3,374,389 3/1968 Cahour et al. ..... 315/39.3 X
3,619,709 11/1971 Dudley et al. ..... 315/39.3
3,646,388 2/1972 Dudley et al. ..... 315/3.5
3,899,714 8/1975 Esterson et al. ..... 315/39.51

*Primary Examiner*—Benny T. Lee
*Attorney, Agent, or Firm*—William R. Clark; Richard M. Sharkansky

[57] ABSTRACT

A cathode of a crossed field device includes a first electrode and a second electrode disposed about and dielectrically spaced from the first electrode. In a preferred embodiment the electrode comprises a pair of electrodes, a first one of the pair being a masking electrode disposed about and dielectrically spaced from the first electrode and a second one of the pair being an emitter electrode disposed about and dielectrically spaced from the masking electrode.

33 Claims, 6 Drawing Sheets

ELECTRODES WITH PRIMARY AND SECONDARY EMITTERS FOR USE IN CROSS-FIELD TUBES

BACKGROUND OF THE INVENTION

This invention relates generally to RF energy sources and more particularly to cross-field type RF energy sources.

As is known in the art, magnetron devices, such as magnetron oscillators, cross-field amplifiers, and the like, are used in radio frequency systems such as radar systems to provide a source of RF energy in the microwave/millimeter wave frequency range. Magnetron based devices convert DC power into relatively high power RF signals with relatively high conversion efficiency.

As is also known, a magnetron includes an evacuated enclosure and an electrode, commonly referred to as a cathode, which is heated to provide thermionically emitted electrons having sufficient mobility to provide a current flow between the heated cathode and at least one additional electrode generally referred to as the anode. The magnetron converts DC power by the interaction of electrons with the electric field of a circuit element in crossed DC electric and magnetic fields. During the interaction process, electron potential energy is converted into the RF energy of the electromagnetic fields resulting in high power signals at microwave and millimeter wave frequencies.

As is also known in the art, there exists a trend toward providing lower noise levels in microwave and millimeter wave radar systems. One problem with magnetron devices used in such systems is that these devices convert DC power to RF power having relatively high noise levels which degrade the sensitivity of radar systems using such devices.

As is also known in the art, a magnetron oscillator is provided by combining a cavity resonator with a magnetron. One example of a magnetron oscillator is the so-called coaxial magnetron oscillator. The coaxial magnetron oscillator includes an anode and a cathode. The anode is provided as a cylindrical resonant cavity of a conductive material such as copper. A portion of the anode provides a resonant circuit which in combination with the resonant cavity determines the frequency of operation of the oscillator. The resonant circuit may be provided by a plurality of electrically conductive rectangular blocks, often referred to as vanes, with each vane having one end terminated at the cylindrical resonant cavity and having a second end extending inward toward the center of the cavity. The vanes function as resonant circuits and serve a purpose similar to that of the lumped constant LC resonant circuits used at lower frequencies. The cathode may be provided as a cylinder of oxide-coated material disposed at the center of the anode.

The region between the anode and the cathode is called the interaction space. The interaction space is the region in which electrons from the cathode interact with DC electric and magnetic fields and the RF electric field in such a manner that the electrons impart their energy to the RF field provided in the interaction space.

Another type of coaxial magnetron is the so-called inverted coaxial magnetron. In this magnetron, the cathode surrounds the anode. A stabilizing $TE_{011}$ cavity is in the center of the magnetron with the so-called vane type resonator system, previously described, arranged on the outside of the cavity. The cathode is provided as a ring surrounding the anode. Power is coupled from the end of the central stabilizing cavity by a waveguide.

Another device which uses the general magnetron concept is a cross-field amplifier (CFA). The CFA includes input and output ports, an anode slow-wave circuit and a cathode. An RF drive signal is provided at the input of the anode slow-wave circuit and a relatively high power RF output signal is provided at the output of the anode slow-wave circuit.

In one embodiment, electrons originate from a cylindrical cathode which is coaxial to the slow-wave circuit that acts as the anode. As in the magnetron oscillator, the region between the anode and the cathode is called the interaction space.

One technique which has been suggested to provide a low noise CFA is described in U.S. Pat. No. 4,928,070 by MacMaster et al. and assigned to the assignee of the present invention.

In the above mentioned patent low noise operation of a cross-field amplifier is provided by feeding an input RF signal to both a cathode slow-wave circuit and an anode slow-wave circuit. The relative amplitude and phase of each signal applied to the slow-wave circuits of the anode and the cathode are controlled, and the outputs of the anode and the cathode slow-wave circuits are terminated in matched characteristic impedances. This approach provides cross-field amplifiers with improved signal to noise ratios.

In both the magnetron oscillator and the cross-field amplifier, the electron and RF signal interactions which take place in the interaction space is similar. In the interaction space, primary electrons emitted from the cathode which are out of phase with the RF electric field interact with the RF electric field as well as the DC electric and magnetic fields in such a manner that the electrons give up their energy to the RF field. The magnetic field, which is axially aligned with the cathode, passes through the interaction space parallel to the cathode and perpendicular to the DC electric field.

The RF electric field and the crossed electric and magnetic fields cause the electrons to be completely bunched almost as soon as they are emitted from the cathode. After becoming bunched, the electrons move along in a traveling-wave RF electric field. This traveling-wave field moves at almost the same speed as the electrons, causing RF power to be delivered to the travelling wave.

Electrons emitted from the cathode in phase with the RF electric field are accelerated by the RF field. This acceleration causes the electrons to return to the cathode and strike the cathode. Such electron interaction is called back-bombardment. Back-bombardment increases the cathode temperature. An increase in the cathode temperature causes an increase in thermionic electron emission. Back-bombarding electrons also cause secondary electron emissions to be emitted from the cathode. Temperature increases due to back-bombardment are generally seen as reducing the operational lifetime of the cathode.

The secondary emission of the magnetron cathode surface may be reduced through the addition of slots provided in the cathode. Thus, cut away cathode surfaces have been used to reduce the number of secondary electron emissions from the cathode.

Nevertheless, in general, relatively high noise levels are characteristic of most magnetron type devices. For the reasons mentioned above, this is undesirable. It would be desirable to develop a technique applicable to both cross-field amplifiers and magnetron oscillators to reduce their noise levels to more acceptable levels.

SUMMARY OF THE INVENTION

In accordance with the present invention, a magnetron includes a central electrode and a cathode disposed about said central electrode. In a preferred embodiment the cathode includes a masking electrode disposed about said central electrode and an emitter electrode disposed about said masking electrode. The magnetron further includes an anode disposed about and dielectrically spaced from said cathode. With this particular arrangement, a magnetron provides signals having relatively low noise levels. The central electrode in combination with the cathode and in particular the masking and emitter electrodes allow for control of the ratio of primary to secondary electron emissions. The central electrode may be considered as the anode of an inverted magnetron in which the emitter and masking electrodes provide the cathode. Thus the central electrode and cathode together may be considered as an inverted magnetron diode. Back-bombarding electrons provided to the central electrode from the cathode provide the source of electrons for the device. If the masking and emitter electrodes are provided having large portions thereof removed then few secondary electrons are emitted because of the reduced surface area of the masking and emitter electrodes. Conversely, if the masking and emitter electrodes are provided having small portions thereof removed then more secondary electrons are emitted. Thus, the masking and emitter electrodes, each having portions thereof removed to provide pre-determined patterns, are used to control the ratio of primary to secondary electron emission from the cathode. By controlling the ratio of primary to secondary electron emissions, noise levels of the magnetron are reduced. Further, pre-selected independent voltages may be provided to the central electrode and the cathode. For a predetermined central electrode radius and axial magnetic field strength if the central electrode is provided with a voltage potential which is sufficiently positive with respect to the cathode voltage the inverted magnetron diode is above cutoff and back-bombarding electrons returning to the cathode are attracted to the central electrode and therefore do not provide secondary electron emissions. If the voltage of the central electrode is substantially the same or negative with respect to the cathode voltage then the inverted magnetron diode is placed in the cut-off condition and thus a portion of the electrons entering its interaction space return to the cathode. Therefore, such electrons re-enter the interaction space between the cathode and the anode of the magnetron. However, back-bombarding electrons which are highly accelerated will strike the central electrode and may produce more secondary electron emissions. Thus, parameters such as the potential difference between the central electrode and the cathode, the strength of the DC magnetic field, the central electrode radius and the central electrode material for example are selected to enhance or prevent the flow of both primary and secondary electrons from the cathode to the anode of the inverted magnetron. Thus, the aforementioned parameters further control the ratio of primary to secondary electron emissions into the magnetron interaction space.

In accordance with a further aspect of the present invention, a magnetron oscillator includes a central electrode, a cathode disposed about said central electrode and an anode disposed about said cathode. Said cathode further comprises a masking electrode and an emitter electrode with said masking electrode disposed between said central electrode and said emitter electrode. With such an arrangement, a potential difference between the central electrode and the cathode provides a predetermined ratio of primary to secondary electron emissions from the cathode. By controlling this ratio, low noise operation can be provided from the magnetron.

In accordance with a still further aspect of the present invention, a cross-field amplifier (CFA) having an input port, an output port and a slow wave circuit includes a central electrode comprised of a plurality of electrically isolated portions. The CFA further includes a cathode disposed about said central electrode and comprised of a plurality of electrically isolated portions with at least one of said cathode portions comprised of a primary emitter electrode, a masking electrode, and a secondary emitter electrode. With such an arrangement a potential difference between said central electrode and said cathode provides a predetermined ratio of primary to secondary electron emissions in the CFA. By controlling the ratio of primary to secondary electron emissions, a low noise CFA is provided. Further, a CFA operating in a low noise mode may have a reduced number of electrons striking the cathode which provides a concomitant reduction in cathode temperature which improves operating life and reliability of the CFA.

BRIEF DESCRIPTION OF THE DRAWINGS

The foregoing features of this invention, as well as the invention itself, may be more fully understood from the following detailed description of the drawings in which.

DESCRIPTION OF THE PREFERRED EMBODIMENTS

Figure 1:
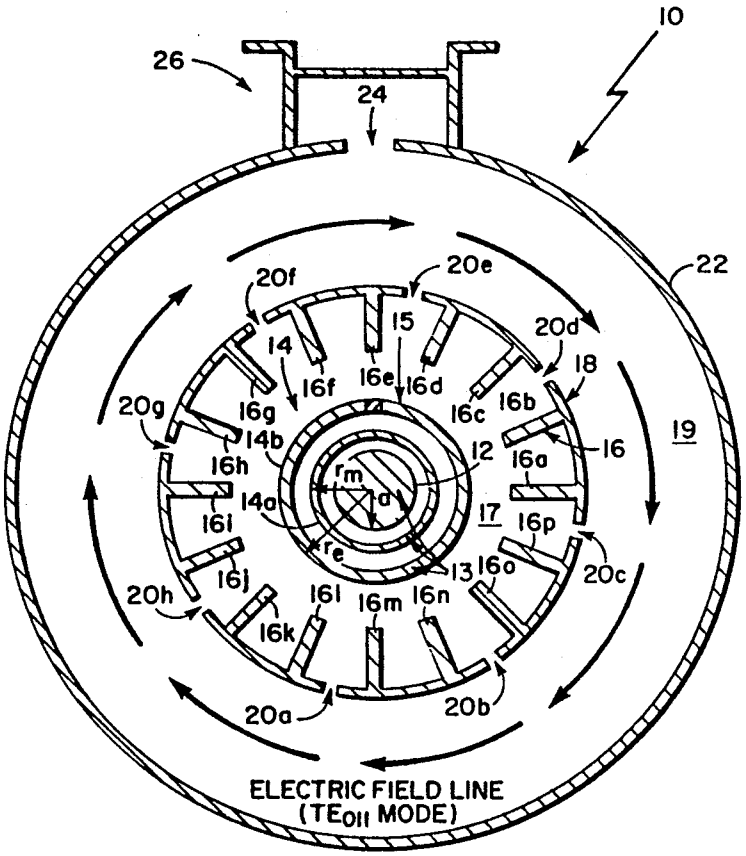
FIG. 1 is a cross-sectional view taken transversely to the longitudinal axis of a coaxial magnetron oscillator.

Referring now to FIG. 1, a magnetron oscillator 10 is shown to include a central electrode 12 comprised of a highly conductive material such as copper or platinum and having a radius "a". The central electrode 12 may be provided as a solid or hollow cylinder. An optional dielectric coating (not shown), may be provided to the surface of the central electrode 12. The particular dielectric coating is selected to either promote or alternatively to reduce the amount of secondary electron emissions from the central electrode 12. Such coatings are well known in the art and may be provided to the central electrode 12 via well-known sputtering techniques.

For example, a coating of graphite (not shown) disposed over a peripheral surface (not numbered) of the central electrode 12 and bombarded with positive charged ions to provide the graphite having a textured surface reduces the amount of secondary electron emission from the central electrode 12. However, a coating of oxidized beryllium or alumina, disposed over the surface of the central electrode 12 increases the amount of secondary electron emission from the central electrode 12.

Figure 2:
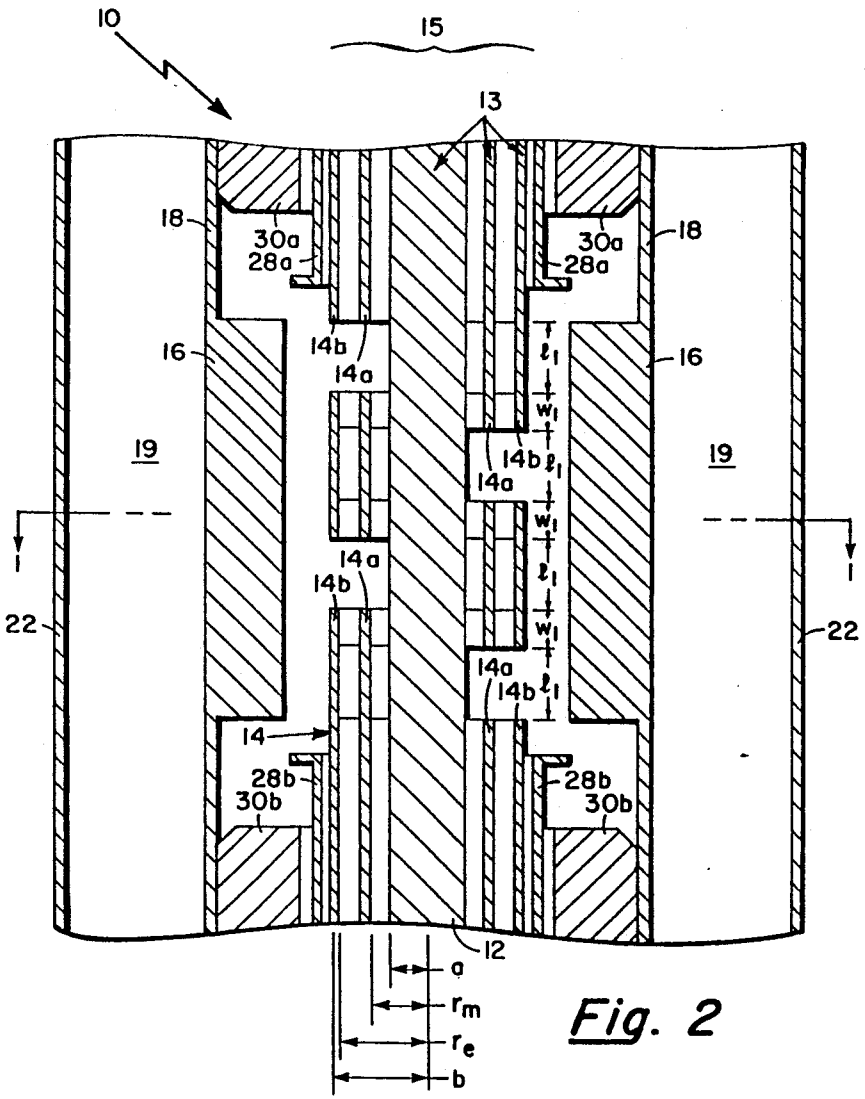
FIG. 2 is a cross-sectional view taken along the longitudinal axis of the magnetron oscillator of FIG. 1.

The oscillator 10 further includes a directly heated cathode 14 having a nominal radius b (FIG. 2). In a preferred embodiment the cathode 14 includes a masking electrode 14*a* of radius $r_m$, comprised of a refractory metal such as tungsten or molybdenum (Mo) for example and an emitter electrode 14*b* of radius $r_e$ and comprised of, for example, thoriated tungsten and having a carbonized surface as is generally known in the art. Cathode 14 is here concentrically disposed about the central electrode 12. The electrodes 14*a*, 14*b* are preferably selected to have substantially corresponding predetermined patterns, the pattern shown here corresponding to the so-called ring and bar configuration well known to those of skill in the art and described in conjunction with FIG. 1A. Other patterns could, of course, be used.

Figure 2A:
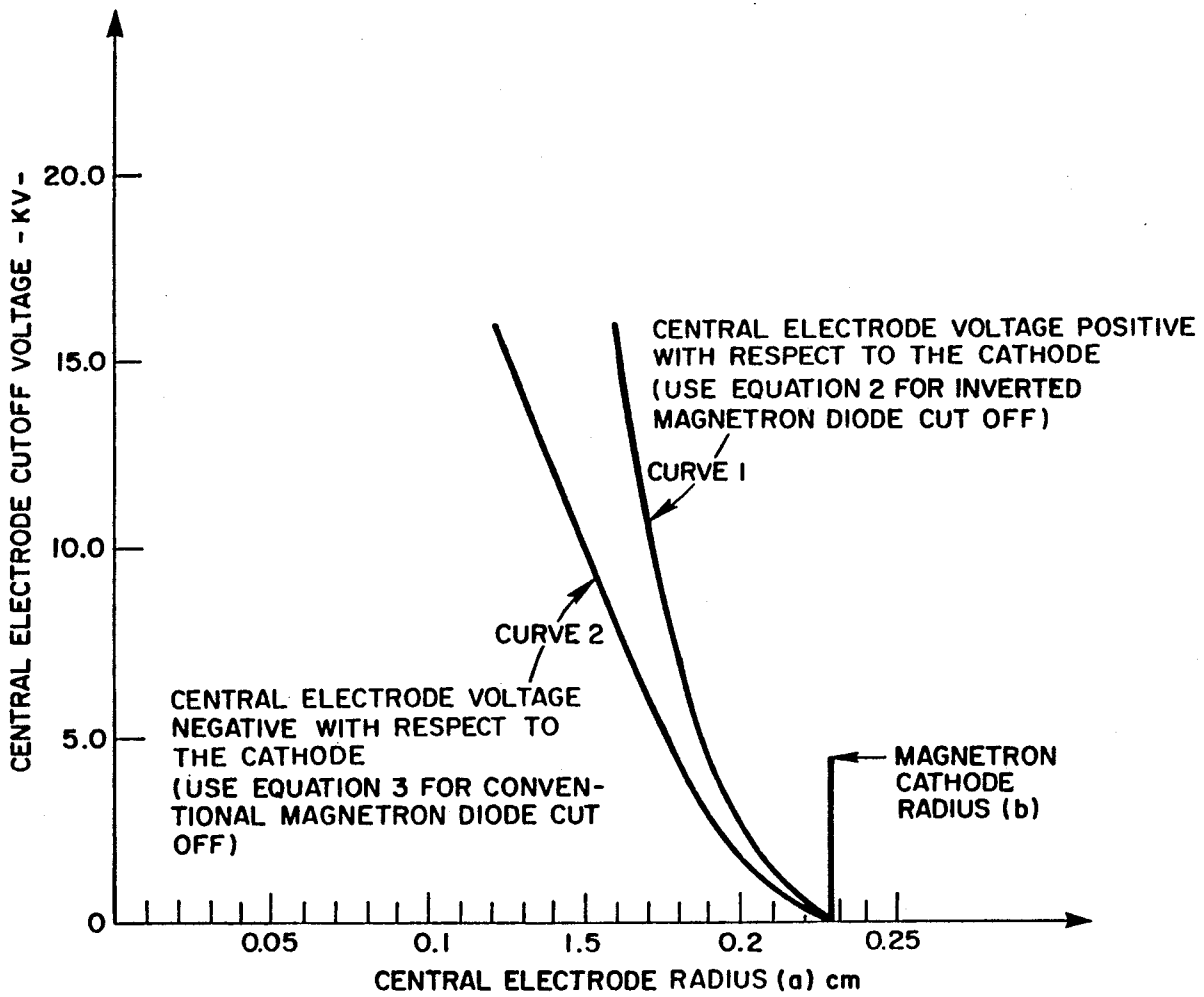
FIG. 2A is a plot of the central electrode radius in CM vs. the central electrode voltage in KV.
Figure 2D:
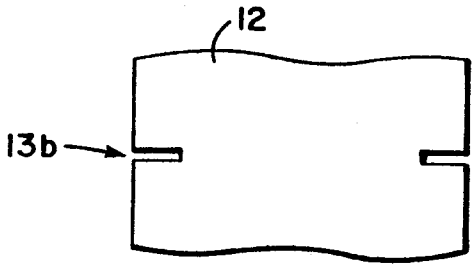
FIG. 2D is an enlarged view of a portion of the central electrode in FIG. 2C having a groove with a rectangular cross section.

The spacing between the radius "a" of central electrode 12 and the nominal radius "b" of the cathode 14 may be selected to provide the magnetron oscillator 10 having the desired electrical characteristics as will be further discussed in conjunction with FIG. 2A. The masking and emitter electrodes 14*a*, 14*b* are provided having a thickness typically of about 0.005 inches. The spacing between the outer radius $r_m$ of masking electrode 14*a* and the inner radius $r_e$ of emitter electrode 14*b* is in the range of 0.005 inches to 0.025 inches.

A conventional anode generally denoted 18 and having a plurality of resonant vanes, here 16*a*, 16*b*, 16*c*, 16*d*, 16*e*, 16*f*, 16*g*, 16*h*, 16*i*, 16*j*, 16*k*, 16*l*, 16*m*, 16*n*, 16*o*, 16*p* generally denoted as 16, is concentrically disposed about the cathode 14. The anode 18 is a cylindrical conductive member having a surface in which vanes 16 terminate. Conventional coupling slots 20*a*, 20*b*, 20*c*, 20*d*, 20*e*, 20*f*, 20*g*, 20*h* are provided in the anode 18 to allow RF energy (represented in FIG. 1 as Electric Field Line in the $TE_{011}$ Mode) provided by the interaction of the electrons with the RF electric field and the DC electric and magnetic fields (not shown) in an interaction space 17 to be coupled into a cavity 19 which is provided between the anode 18 and the outer conductor 22.

RF energy is coupled from the cavity 19 to an output waveguide 26 through a coupling slot 24 as is generally known to those in the art.

The voltage applied to the central electrode 12 relative to the cathode 14 is dependent upon the central electrode radius "a", the nominal cathode radius "b" and the strength of the applied axial magnetic field (not shown). The potential differences between the central electrode 12, the cathode 14 and the anode 18 may be selected according to the so-called Hull cut-off equation well known to those of skill in the art and provided as $$V_{pc} = \frac{r_p^2}{45.58}\left(\frac{e}{m}\right)(B_z)^2\left[1 - \frac{r_c^2}{r_p^2}\right]^2 \text{ volts} \quad (1)$$

in the book entitled Vacuum Tubes by Karl R. Spangenberg, Published by McGraw-Hill, 1948, Page 645.

In equation (1), the term "r" corresponds to a radius, the subscript "p" corresponds to the plate electrode, also called the anode 18, and the subscript "c" corresponds to the cathode 14. The term $B'_z$ corresponds to the strength of the DC magnetic field in units of gauss.

The above equation defines the so-called Hull cut off condition in a conventional magnetron diode. A conventional magnetron diode 23 is here provided from the cathode 14 and the anode 18. A similar equation describes the cut off relationship for an inverted magnetron diode as will be discussed in conjunction with FIG. 2A. In the present invention the central electrode 12 and the cathode 14 may provide an inverted magnetron diode 13 in which the central electrode 12 acts as the anode as will be discussed in conjunction with FIG. 2A. Thus, in this instance the equation for an inverted magnetron diode should be employed when selecting the voltage potential difference between the central electrode 12 and the cathode 14.

Figure 1A:
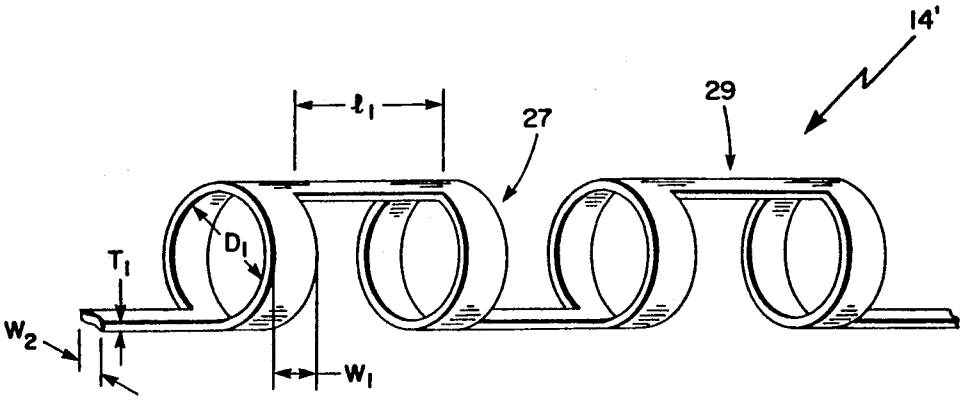
FIG. 1A is an exemplary electrode provided in a ring and bar configuration.

Referring now to FIG. 1A and FIG. 2 an exemplary electrode 14' provided in the so-called ring and bar configuration is shown to include a series of rings, generally denoted 27 having diameter $D_1$, thickness $T_1$, and width $W_1$. The rings 27 are interconnected by a series of bars, generally denoted 29, having width $W_2$ and length $l_1$. The widths $W_1$, $W_2$ as well as length $l_1$ are selected to provide the electrode 14' in a predetermined pattern.

Figure 1B:
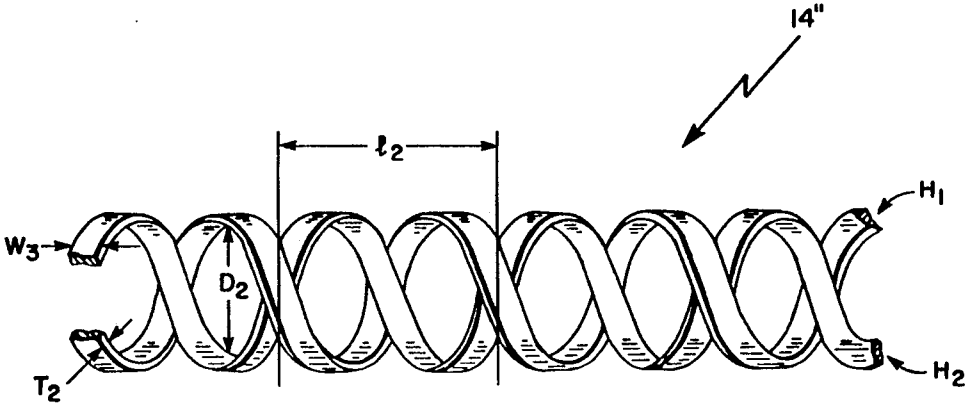
FIG. 1B is an exemplary electrode provided in a bi-filar helix configuration.

Referring now to FIG. 1B, a second exemplary electrode 14" provided in the so-called bi-filar helix configuration is comprised of 2 counter wound helical portions H1 and H2 each having period $l_2$, diameter $D_2$, thickness $T_2$, and width $W_3$ as is commonly known to those in the art. Width $W_3$ and period $l_2$ are selected to provide the electrode 14" having a predetermined pattern.

Referring now to FIGS. 2, 2A where like elements of the magnetron oscillator 10 of FIG. 1 including an emitter electrode of the ring and bar type shown in FIG. 1A are referenced with the same designations, the magnetron oscillator 10 further includes end shields 28*a*, 28*b* and magnet pole pieces 30*a* and 30*b*. The central electrode 12, cathode assembly 14 end shields 28*a*, 28*b* and magnet pole pieces 30*a*, 30*b* may be supported by any conventional means (not shown) well-known to those of skill in the art.

I believe that low noise operation of a magnetron is related to the ratio of primary to secondary electron emissions from the cathode 14. Since the ratio of primary to secondary electron emissions which would provide optimal noise levels would vary depending upon particular characteristics of a particular device, I have provided a cathode structure 15 comprised of central electrode 12 and cathode 14 preferably including masking electrode 14a and emitter electrode 14b. With this particular cathode structure a wide range of primary to secondary electron emission ratios emitted radially outward from the cathode surface may be provided.

Thus by varying the voltage potential between the aforementioned central electrode 12, masking electrode 14a and emitter electrode 14b and choosing appropriate patterns and materials for the aforementioned electrodes, as well as choosing the proper central electrode radius, optimum low noise performance of the magnetron oscillator 10 may be provided.

For example, if low noise levels in the magnetron oscillator 10 are provided by a minimum number of secondary electrons, the number of electrons returning to the magnetron cathode 14 from the central electrode 12 should be kept to a minimum. Thus the emitter electrode 14b would have a maximum portion thereof removed consistent with the required primary emission, emitter temperature and operating life.

Further, the central electrode 12 should be provided having a voltage potential greater than the voltage potential provided to the cathode 14. With this particular arrangement, the central electrode 12 and the cathode 14 thus provide the inverted magnetron diode 13 in which the central electrode 12 acts as the anode of the inverted diode 13.

As an illustrative example assume thus the magnetron has an anode of the hole and slot type having double ring strapping and a nominal anode radius typically of about 0.683 centimeter (cm), a cathode having a nominal radius typically of about 0.227 cm and a DC magnetic field (Bz) having a strength of 5200 gauss. The voltage provided to the central electrode 12 should be selected to correspond to a voltage above the cut off voltages indicated by curve 1 in FIG. 2A. The central electrode 12 should be provided having a radius "a" and a voltage selected to maximize the distance between the central electrode 12 and the cathode 14.

The so-called cut-off voltage $V_{co}$ indicated by curve 1 in FIG. 2A for the inverted magnetron diode 13 is provided from equation (2).

$$V_{co} = \frac{a^2 B_z^2}{45.48}\left[1 - \frac{b^2}{a^2}\right]^2 \qquad (2)$$

In Equation (2) $V_{co}$ is the positive central electrode voltage in units of volts, $B_z$ is the axial magnetic field in units of gauss, "a" is the radius of the central electrode 12 in units of centimeters and "b" is the effective radius of the cathode 14 in units of centimeters.

The surface of the central electrode 12 should be provided from a material having a low secondary emission ratio. Further, the number of secondary electron emissions generated from central electrode 12 by a back-bombarding electrode is related to the angle at which the back-bombarding electron strike the surface of the central electrode. Back-bombarding electrons which contact a large surface area of the central electrode 12 (i.e. strike the central electrode 12 at an oblique or glancing angle) generally produce many secondary electron emissions. Back-bombarding electrons which contact a small surface area of the central electrode 12 (i.e. strike the central electrode in a direction normal to the surface) generally produce fewer secondary electron emissions.

Thus, if back-bombarding electrons impact the central electrode 12 at an angle, normal to the surface of the central electrode, then a smooth central electrode having a smooth surface would provide a minimum number of secondary electron emissions from the central electrode 12. If, however, electrons from the cathode 14 strike the surface of the central electrode 12 at oblique angles, then the central electrode 12 may have a roughened or grooved surface provide a minimum number of secondary electron emissions.

Figure 2E:
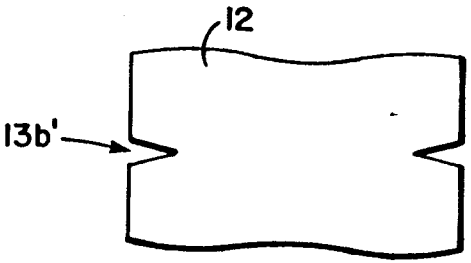
FIG. 2E is an enlarged view of a portion of the central electrode in FIG. 2C having a groove with a V-shaped cross section.
Figure 2C:
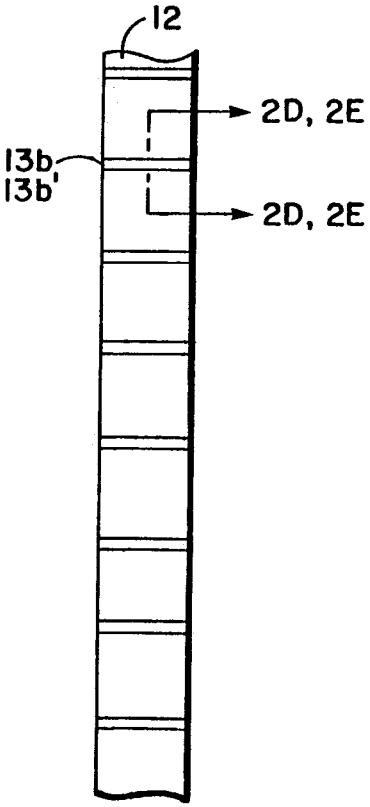
FIG. 2C is a central electrode having a groove provided as a series of rings.
Figure 2B:
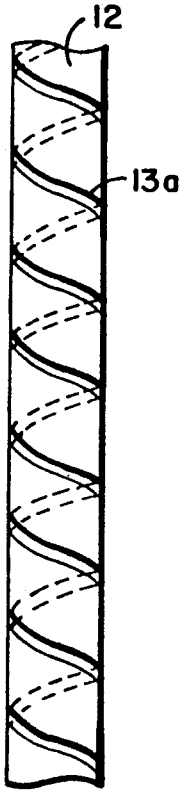
FIG. 2B is a central electrode having a helical groove.

Referring now to FIGS. 2B–2E, examples of techniques to provide a roughened surface to central electrode 12 for controlling secondary emissions is shown. In particular, the central electrode 12 has a groove 13a (FIG. 2B) or a series of rings 13b (FIG. 2C) disposed along a peripheral, outer surface portion thereof. As shown in FIG. 2B, the groove 13a has a helical shape. Alternatively, as shown in FIG. 2C, roughened surface is provided as a series of rings 13b, 13b' as a series of rings. Whether the groove is provided having a helical shape 13a (FIG. 2B) or as a series of rings 13b, 13b' (FIG. 2C) the grooves 13a (FIG. 2B) 13b, 13b' (FIG. 2C) may be provided having either a rectangular cross-sectional shape (FIG. 2D) or a cross-section which is V-shaped (FIG. 2E).

The patterns of masking and emitter electrodes 14a, 14b as well as the potential difference between central electrode 12 and masking and emitter electrodes 14a, 14b are selected to ensure that the electric field between these electrodes is sufficiently strong to prevent the escape of both elastically reflected electrons and secondary electrons from the cathode surface. This further reduces the number of secondary electron emissions.

Alternatively, assuming the same anode, cathode and DC magnetic field described above, if low noise performance requires a high level of secondary electron emission by the cathode 14 the voltage potential of the central electrode 12 would be made less than the Hull cut off value (i.e. negative with respect to the voltage potential of the cathode 14). The central electrode 12 should be provided having a radius "a" approximately corresponding to the nominal radius "b" of the cathode 14. Further, the surface of the central electrode 12 should be provided from a material having a high secondary electron emission ratio. Also, the removed portions of the cathode 14 would be made as large as possible consistent with the required primary emission.

With this particular arrangement to provide the magnetron oscillator having a low noise characteristic the resulting secondary emission should be substantially greater than the thermionic primary emission from the emitter electrode 14b.

The cutoff voltage for the novel central electrode 12 arrangement is plotted as curve 2 in FIG. 2A using the same parameter values as the inverted magnetron diode case but employing the conventional magnetron diode cutoff relationship provided in equation (3).

$$V_{co} = \frac{b^2 B_z^2}{45.48}\left[1 - \frac{a^2}{b^2}\right]^2 \qquad (3)$$

The negative voltage applied to the central electrode would be above cutoff, that is it would be to the right of curve 2 shown in FIG. 2A.

In this case, with the voltage of the central electrode 12 negative with respect to the voltage of the magnetron cathode 14 the masking grid 14*a* is optional and preferably omitted. The central electrode 12 should be provided having a surface selected to enhance secondary emission. Further, the surface of the central electrode 12 should be selected to assure that the secondary electrons emitted return to the magnetron interaction space 17.

The central electrode 12 may be provided for example having a platinum or a beryllium base metal with a 200 Angstrom (Å) layer of beryllia disposed thereon. The surface of the central electrode 12 would be provided so that arriving electrons would strike the surface of the central electrode 12 at a glancing angle. Thus in this embodiment, the central electrode 12 should provide a high number of secondary emission electrons and therefore back-bombarding electrons should provide a source for the high level of secondary electron emission.

If low noise performance required a specific ratio of primary to secondary electron emission, then the parameters discussed above such as the pattern of the cathode 14, the radius of the central electrode 12, and the voltage potentials would be selected to provide this ratio.

The primary to secondary emission ratio required for low noise performance may vary over the operating life of the magnetron. Hence it would be desirable to permit small adjustments in primary to secondary emission ratio. With the proposed invention, the cathode assembly 15 allows for changing the voltage potential on the cathode 14 and also the voltage potential difference between the cathode 14 and the central electrode 12. Thus, adjustments to the voltage potential are possible as characteristics of the magnetron vary during operation.

As will be now recognized by those of skill in the art, the technique described above for a coaxial magnetron oscillator is easily adaptable to any type of magnetron oscillator, including an inverted coaxial magnetron oscillator, having any of the various forms of multi-segment anodes, including but not limited to the "slot" type and "rising sun" type of anodes, well known to those of skill in the art.

Figure 3A:
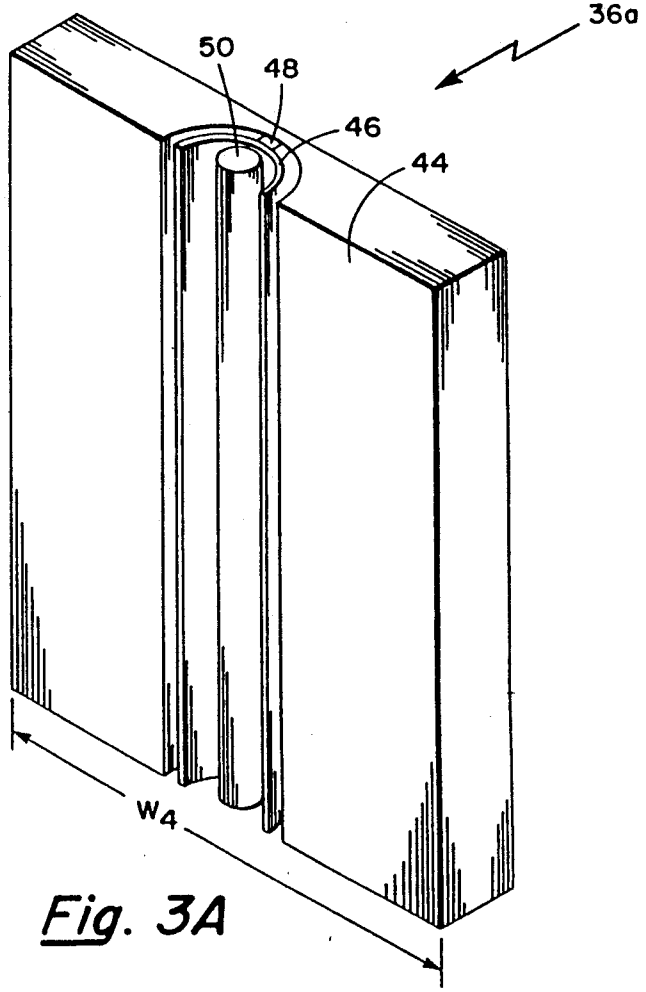
FIG. 3A is an enlarged isometric view of a portion of a cathode of the type used in the crossed field amplifier of FIG. 3.
Figure 3:
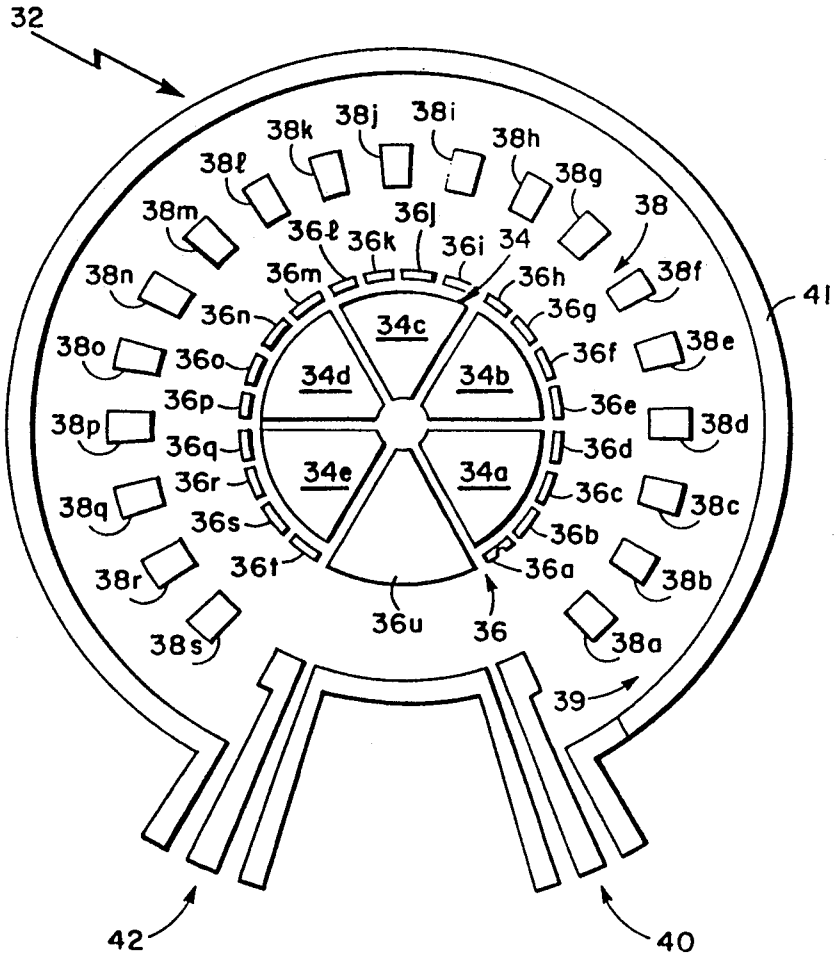
FIG. 3 is a cross-sectional view taken transversely to the longitudinal axis of a crossed field amplifier.

Referring now to FIG. 3, a cross-field amplifier (CFA) 32 is shown to include a central electrode, generally denoted 34, comprised of electrically isolated sectors 34*a*, 34*b*, 34*c*, 34*d*, 34*e* with each sector being comprised of either a highly conductive material such as copper or platinum or a suitably chosen secondary emitter material.

Cathode assembly 36 is comprised of electrically isolated sectors 36*a*, 36*b*, 36*c*, 36*d*, 36*e*, 36*f*, 36*g*, 36*h*, 36*i*, 36*j*, 36*k*, 36*l*, 36*m*, 36*n*, 36*o*, 36*p*, 36*q*, 36*r*, 36*s*, 36*t*, 36*u* with selected ones thereof having a channel (not numbered) in which is disposed a masking electrode (not shown). Here, the CFA 32 is provided having four cathode sectors per central electrode sector, however the number of cathode sectors per central electrode sector is determined empirically and may be varied to provide optimum low noise characteristics of the CFA 32. The width W4 (FIG. 3A) of individual cathode sectors as well as the spacing (not numbered) between adjacent cathode sectors is here be selected to adjust the ratio of primary to secondary electron emission. Here, equal spacing is provided between the cathode sectors 36*a*–36*u*. However, it should be noted that the spacing between adjacent cathode sectors need not be equal. The spacing between the cathode sectors may be varied to provide optimum low noise characteristics of CFA 32.

Referring momentarily to FIG. 3A, an exemplary cathode sector 36*a* includes a primary emitter electrode 50 which may be provided as a rod as shown or alternatively as the so-called ring and bar (FIG. 1A) or bi-filar helix (FIG. 1B) structure comprised of thoriated tungsten, for example, as described above. A masking electrode 46 is disposed about and dielectrically spaced from primary emitter electrode 50 and provides a barrier between primary emitter electrode 50 and secondary emitter electrode 44. Masking electrode 46 is, in general, provided having the same predetermined pattern as the primary emitter electrode 50. Secondary emitter electrode 44 having a portion thereof removed provides a surface in which masking electrode 46 may contact secondary emitter electrode 44 via dielectric support 48. Primary emitter electrode 50 as well as secondary emitter 44 are supported at the end portions thereof by conventional dielectric supports (not shown).

Electrodes 46 and 50 are provided with substantially equal voltage potentials and thus, there is no electrical interaction between the two electrodes. A voltage potential difference between cathode sector 36*a* and an anode 38 (FIG. 3) is selected to provide primary emission of electrons. The potential difference is also selected to provide stable operation of the cross-field amplifier in the low noise mode.

Referring again to FIG. 3 cross-field amplifier 32 further includes an anode slow-wave circuit generally denoted as 38 disposed about cathode 36. As is generally known, anode 38 is comprised of electrically isolated sectors 38*a*, 38*b*, 38*c*, 38*d*, 38*e*, 38*f*, 38*g*, 38*h*, 38, 38*j*, 38*k*, 38*l*, 38*m*, 38*n*, 38*o*, 38*p*, 38*q*, 38*r*, 38*s* and an RF path 39 is provided between outer wall 41 and anode 38 (shown in FIG. 3) in which the RF wave travels. As is also known, RF ports 40 and 42 provide input and output signal paths to cross-field amplifier 32.

It should be noted that central electrode sectors 34*a*–34*e*, cathode sectors 36*a*–36*u* and anode sectors 38*l*–38*s* need not be geometrically symmetric structures. The structure of the aforementioned electrodes will affect noise levels of the CFA. Further, the voltage potential between each cathode sector 36*a*–36*u* and the anode 38 is selected to provide stable operation of the CFA 32 in the low noise mode. In general, an equal potential difference between cathode sectors 36*a*–36*u* and the anode 38 is provided. Thus, various geometric structures of the aforementioned electrodes as well as the potential difference between cathode sectors 36*a*–36*u* and anode 38 may be used to provide signals having low noise levels in the CFA.

The optimum ratio of primary to secondary electron emissions to provide low noise CFA operation varies as the RF signal travels angularly around cathode 36. At the input side of cathode 36 a sufficient number of primary electrons are generally required to initiate the interaction process between the electrons and the electromagnetic fields.

The primary electrons strike the surface 44 (FIG. 3A) of the cathode 36 and generate secondary electrons. If the combined number of primary and secondary electrons are sufficient to sustain the interaction between the electrons and the electromagnetic field, it is not required to have further emission of primary electrons. Because the ratio of primary to secondary electron emission required to provide low noise characteristics may thereafter be low, the number of primary emitter electrodes is preferably reduced as the RF field moves angularly around the CFA cathode 36 from the input port 40 to the output port 42.

It should be noted however, that if the RF input signal is of sufficiently high power then the CFA may operate without a primary emitter electrode.

Although the CFA described herein is of the so-called re-entrant type, the cathode configuration described herein would provide the same advantages to a so-called non re-entrant CFA.

I have operated a conventional CFA wherein, in the presence of the DC magnetic field, a voltage is applied to the CFA cathode and after a threshold voltage is reached the cathode begins to draw current. At the threshold voltage a small increase in voltage produces a large increase in current. As the cathode current is increased, a current level is reached in which a CFA may operate with a lower noise characteristic. When this occurs, the slope of the voltage-current curve becomes briefly negative before it becomes positive again at a slightly higher voltage level and lower current level.

The CFA operates in this low noise state at the higher voltage level for a small increase in anode current. After this small current increase, higher order modes of the RF electromagnetic wave are produced and the CFA becomes inoperable. This phenomena is generally referred to as moding. A conventional CFA operated for a period of time in the aforementioned high voltage, low current, low noise state, eventually provides RF signals having high noise levels. An increase in cathode current is then required to maintain low noise operation.

I believe that the CFA changes from the high noise to the low noise state because of a change in the ratio of primary to secondary electron emissions at various angular locations around the interaction space. I postulate that the CFA shifts from the noisy to quiet states when the CFA cathode secondary emission ratio is inadequate to supply the set level of cathode current. Similarly, operation in the low noise state at the higher voltage level is postulated to be limited by inadequate cathode emission causing the CFA to mode.

The cathode configuration described herein is proposed to produce the quiet to noisy transition at the desired current level and to increase the range of current over which low noise operation occurs.

When the transition from the noisy state to the quiet state is caused to occur in a magnetron by adjusting the heater voltage, there is a 200 to 300 degree Celsius reduction in cathode temperature. The power supplied to the primary emitter electrode and the product of anode current and voltage are both essentially constant during the transition from the noisy to quiet mode. Thus it is theorized that the principal change after the transition from the noisy mode to the quiet mode is a significant reduction in the back bombardment power impinging on the cathode. One cannot tell, however, whether this is a reduction in the number of high energy back bombarding electrons or whether it is a reduction in the energy level of all returning electrons.

If one assumes, in the above-mentioned CFA performance, that after the transition from the noisy state to the quiet state there is a sudden reduction in the number of back bombarding electrons, then the number of primary electrons contributing to the anode current increases substantially since the anode current is essentially constant during the transition. This, however, is inconsistent with a reduction in cathode temperature. Thus one alternative explanation is that the number of high energy and elastically reflected electrons are substantially reduced, however those electrons which do return to the cathode, strike the cathode at an oblique angle rather than at normal incidence thereby providing more secondary electrons and thus keeping the anode current nearly constant.

Electrons which strike the cathode at an oblique angle provide a larger secondary emission ratio than electrons which strike the cathode at a right angle. This results in a corresponding increase in the number of secondary emission electrons and thus provides the constant anode current.

In the above cited conventional CFA example, it is further theorized that the number of available secondary emission electrons must have been limited causing the CFA to mode with increasing levels of anode current. Thus, it is proposed to expand the range of operating current in the quiet state by increasing the supply of secondary electrons.

In the current invention, the supply of secondary emission electrons is increased by providing the surface of central electrode 34 and the surface of cathode 36 with a material having a high secondary to primary emission ratio. Further, the distance between adjacent cathode sectors **36*a*–36*u* may be selected to optimize the number of electrons entering the region between the cathode and the central electrode. Moreover, the distance between the central electrode sectors and the cathode sectors in addition to the potential difference between these electrodes would be selected to enhance the return of secondary electrons to the interaction space (not numbered). The parameters discussed above may be adjusted at different cathode sectors to provide optimum noise characteristics of the CFA 32**.

Figure 4:
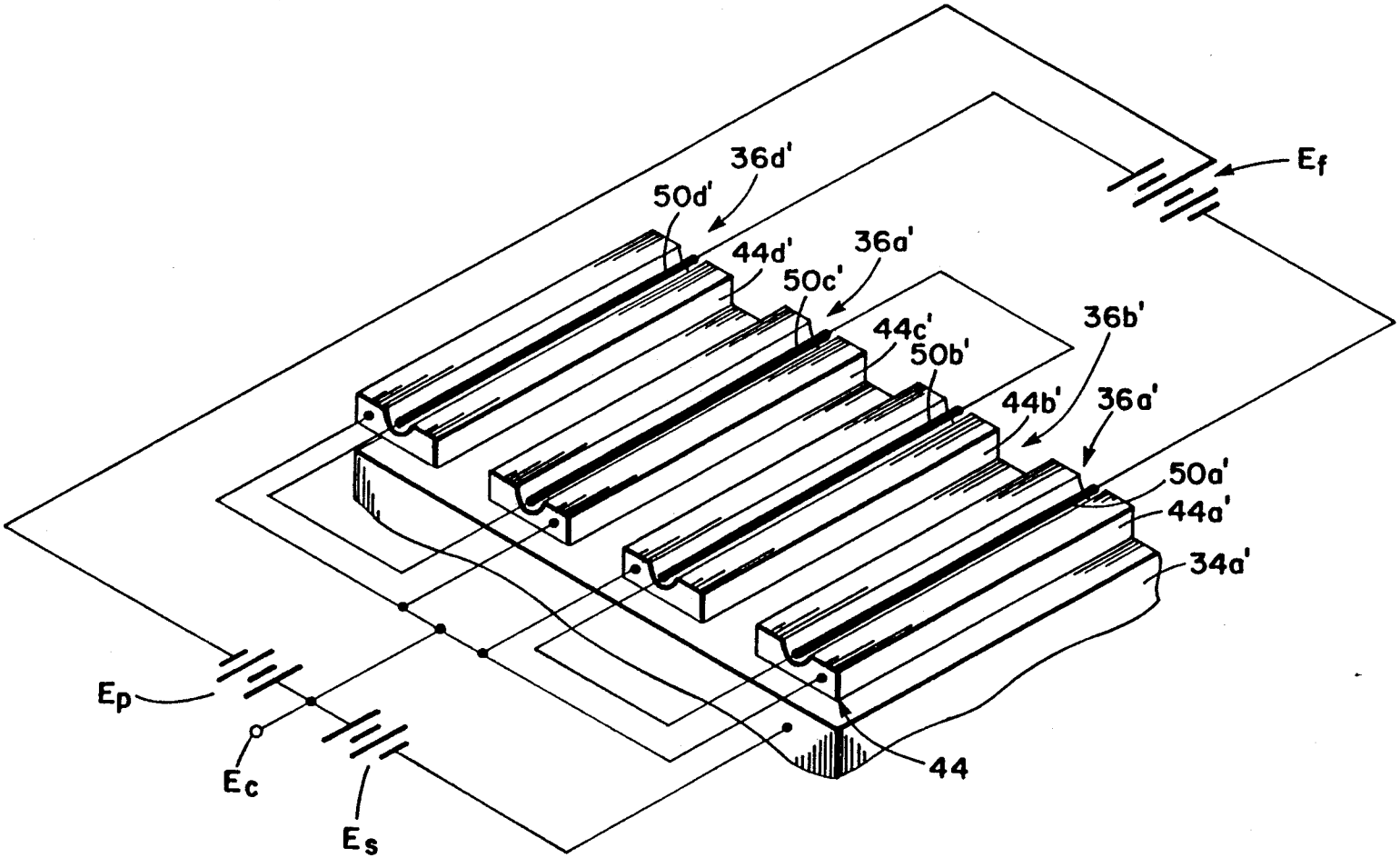
FIG. 4 is a diagrammatical representation of the electrical connections of a portion of the crossed field amplifier of FIG. 3.

Referring now to FIG. 4, an exemplary portion of a CFA includes a portion of central electrode **34*a*', secondary emitter electrodes 44*a*', 44*b*', 44*c*', 44*d*', and primary emitter electrodes 50*a*', 50*b*', 50*c*, 50*d*'. A reference potential is provided to the surface of secondary emitter electrode generally denoted 44' with all of the individual elements that make up this surface electrically connected. The potential difference between central electrode 34*a*' and electrodes 44*a*'–44*d*' is adjusted by the voltage Es. The voltage Es may be selected to vary the emission of the secondary electrons from the central electrode 34*a* by adjusting the potential difference between central electrode 34*a*, and cathode sectors 44*a*'–44*d*'** or by adjusting their radial spacing.

Primary emitter electrodes **50*a*'–50*d*' are connected in series and heated by current produced by the potential source Ef. The potential of the primary emitter electrodes 50*a*'–50*d*' would also be made adjustable relative to the cathode by voltage Ep. The polarity of this potential would accelerate electrons from the primary emitter electrodes 50*a*'–50*d*' to secondary emitter electrodes 44*a*'–44*d*'. Thus, primary electrons could be supplied directly to the CFA space charge or primary electrons can produce secondary electron emissions at secondary emitter electrodes 44*a*–44*d*'** which would then contribute to the CFA space charge.

The voltage values required for Ef and Ep will determine the number of primary emitter electrodes that can be connected in series. The value of Ef could not become large with respect to Ep with out upsetting operation. As a result it would be necessary to limit the number of primary emitter electrodes that can be connected in series. The values of Es, Ep and Ef may be adjusted to different levels between central electrode sectors and cathode sectors in an individual CFA to achieve low noise performance. However, it is expected that all the secondary emitter electrodes would remain at substantially the same electrical potential.

Having described preferred embodiments of the invention, it will now become apparent to one of skill in the art that other embodiments incorporating their concepts may be used. It is felt, therefore, that these embodiments should not be limited to disclosed embodiments, but rather should be limited only by the spirit and scope of the appended claims.

What is claimed is:

1. A cathode and anode arrangement for use in a crossed field device, said cathode and anode arrangement comprising, in combination:

said cathode having a first emitter electrode with a peripheral surface and a second electrode disposed adjacent to and spaced from said first emitter electrode, wherein said second electrode comprises a primary emitter electrode, a masking electrode disposed adjacent to and spaced from said primary emitter electrode and a secondary emitter electrode disposed adjacent to and spaced from said masking electrode; and said anode disposed adjacent to and spaced from said second electrode.

2. The cathode and anode arrangement of claim 1 wherein a groove is disposed along said peripheral surface of said first electrode.

3. The cathode and anode arrangement of claim 2 wherein said first electrode has a layer comprised of tungsten disposed over said peripheral surface of said first electrode.

4. The cathode and anode arrangement of claim 3 wherein said groove comprises a pair of sides joined along a common line.

5. The cathode and anode arrangement of claim 3 wherein said groove comprises a pair of substantially parallel sides each joined at substantially right angles by a bottom surface.

6. The cathode and anode arrangement of claim 2 wherein said peripheral surface of said first electrode has a layer comprised of graphite disposed thereon.

7. The cathode and anode arrangement of claim 6 wherein said groove comprises a pair of substantially parallel sides each joined at substantially right angles by a bottom surface.

8. The cathode and anode arrangement of claim 6 wherein said groove comprises a pair of sides joined along a common line.

9. The cathode and anode arrangement of claim 1 wherein said first electrode has a layer comprised of beryllium oxide disposed over said peripheral surface of said first electrode.

10. The cathode and anode arrangement of claim 9 wherein said groove comprises a pair of substantially parallel sides each joined at substantially right angles by a bottom surface.

11. The cathode and anode arrangement of claim 10 wherein said groove comprises a pair of sides joined along a common line.

12. A cathode and central emitter electrode for use in a crossed field amplifier, said cathode and central emitter comprising, in combination:

said cathode disposed adjacent to and spaced from said central emitter electrode, wherein said cathode is comprised of a plurality of sectors and at least one of said cathode sectors comprises a primary emitter electrode; a masking electrode disposed adjacent to and spaced from said primary emitter electrode; a secondary emitter electrode disposed adjacent to and spaced from said masking electrode.

13. The cathode and central emitter electrode of claim 12 wherein said central emitter electrode is comprised of a plurality of sectors.

14. A cathode and central emitter electrode for use in a magnetron oscillator, said cathode and emitter comprising, in combination:

said cathode disposed adjacent to and spaced from said central emitter electrode, wherein said cathode comprises a primary emitter electrode, a masking electrode disposed adjacent to and spaced from said primary emitter electrode and a secondary emitter electrode disposed adjacent to and spaced from said masking electrode.

15. The cathode and central emitter electrode of claim 14 wherein said masking electrode is comprised of Molybdenum.

16. The cathode and central emitter electrode of claim 14 wherein said masking electrode is comprised of Tungsten.

17. The cathode and central emitter electrode of claim 14 wherein said masking electrode and said primary and secondary emitter electrodes are respectively arranged in a ring and bar pattern.

18. The cathode and central emitter electrode of claim 14 wherein said masking electrode and said primary and secondary emitter electrodes are respectively arranged in a bifilar helix pattern.

19. The cathode and central emitter electrode of claim 14 wherein said primary and secondary emitter electrodes are each comprised of thoriated tungsten and said primary and secondary emitter electrode each have a peripheral surface with graphite disposed thereon and said masking electrode is comprised of a refractory metal.

20. The cathode and central emitter electrode of claim 14 wherein said central electrode has a peripheral surface portion with a groove disposed therealong.

21. The cathode and central emitter of claim 20 wherein said peripheral surface of said central electrode has a layer comprised of graphite disposed thereon.

22. The cathode and central emitter electrode of claim 20 wherein said groove comprises a pair of substantially parallel sides each joined at substantially right angles by a bottom surface.

23. The cathode and central emitter electrode of claim 20 wherein said groove comprises a pair of sides joined along a common line.

24. The cathode and central emitter electrode of claim 20 wherein said central electrode has a layer comprised of beryllium oxide disposed over said peripheral surface thereof.

25. The cathode and central emitter electrode of claim 24 wherein said groove comprises a pair of substantially parallel sides each joined at substantially right angles by a bottom surface.

26. The cathode and central emitter electrode of claim 24 wherein said groove comprises a pair of sides joined along a common line.

27. The cathode and central emitter electrode of claim 20 wherein said central electrode has a layer comprised of tungsten disposed over said peripheral surface thereof.

28. The cathode and central emitter electrode of claim 27 wherein said groove comprises a pair of substantially parallel sides each joined at substantially right angles by a bottom surface.

29. The cathode and central emitter electrode of claim 27 wherein said groove comprises a pair of sides joined along a common line.

30. A cathode of a crossed field device comprising:

a first emitter electrode having a peripheral surface; and a second electrode comprising a plurality of isolated sectors disposed adjacent to and spaced from said first electrode, wherein at least one of said plurality of electrode sectors comprises a primary emitter electrode, a masking electrode disposed adjacent to and spaced from said primary emitter electrode and a secondary emitter electrode disposed adjacent to and spaced from said masking electrode.

31. The cathode of claim 30 wherein said first electrode is comprised of a plurality of sectors.

32. The cathode of claim 30 wherein said first emitter electrode has a layer of graphite disposed on said peripheral surface.

33. The cathode of claim 30 wherein said first electrode has a layer of beryllium oxide disposed on said peripheral surface.

* * * * *